US007699116B2

(12) United States Patent
de Ris et al.

(10) Patent No.: US 7,699,116 B2
(45) Date of Patent: Apr. 20, 2010

(54) ANTI-SKIPPING SPRINKLER

(75) Inventors: John L. de Ris, Foxborough, MA (US); Hong-Zeng Yu, Foxboro, MA (US); Benjamin D. Ditch, Worcester, MA (US)

(73) Assignee: FM Global Technologies, Johnston, RI (US)

( * ) Notice: Subject to any disclaimer, the term of this patent is extended or adjusted under 35 U.S.C. 154(b) by 0 days.

(21) Appl. No.: 12/000,533

(22) Filed: Dec. 13, 2007

(65) Prior Publication Data

US 2009/0151962 A1 Jun. 18, 2009

(51) Int. Cl.

| | |
|---|---|
| ***A62C 37/11*** | (2006.01) |
| ***A62C 37/08*** | (2006.01) |
| ***B05B 1/28*** | (2006.01) |
| ***B05B 15/04*** | (2006.01) |

(52) U.S. Cl. ..... 169/37; 169/38; 169/57; 239/288; 239/288.5

(58) Field of Classification Search ..... 169/37–39, 169/41, 56–59, 91; 239/288, 288.3, 288.5
See application file for complete search history.

(56) References Cited

U.S. PATENT DOCUMENTS

| | | | | |
|---|---|---|---|---|
| 399,519 | A | 3/1889 | Grinnell et al. | |
| 515,938 | A | 3/1894 | McLauthlin et al. | |
| 2,927,646 | A | 3/1960 | Mouser | |
| 3,223,171 | A | 12/1965 | Groot et at. | |
| 3,388,747 | A | 6/1968 | Hodnett | |
| 3,389,884 | A * | 6/1968 | Ault | 248/345 |
| 3,393,746 | A | 7/1968 | Hodnett | |
| 3,684,025 | A | 8/1972 | Livingston | |
| 3,727,695 | A | 4/1973 | Danton | |
| 3,874,455 | A | 4/1975 | Klesow | |
| 4,066,129 | A * | 1/1978 | Anderson | 169/37 |
| 4,616,710 | A | 10/1986 | Pilant et al. | |
| 5,020,601 | A | 6/1991 | Retzloff et al. | |
| 6,641,059 | B2 | 11/2003 | Waligorski | |
| 6,669,111 | B2 | 12/2003 | Vinson et al. | |
| 2003/0173094 | A1 | 9/2003 | Vinson et al. | |
| 2003/0201341 | A1 | 10/2003 | Wancho et al. | |
| 2005/0035022 | A1 * | 2/2005 | Ide et al. | 206/528 |

OTHER PUBLICATIONS

International Search Report of PCT/US2008/013700 filed Dec. 12, 2008.

(Continued)

*Primary Examiner*—Darren W Gorman
(74) *Attorney, Agent, or Firm*—Venable LLP; Clifton E. McCann; Steven J. Schwarz

(57) ABSTRACT

An anti-skipping sprinkler includes a frame defining a central longitudinal axis, the frame including a base portion defining an orifice, and first and second arms extending away from the base portion and joining at a lower end of the frame; a deflector located at the lower end of the frame; an orifice plug held over the orifice by a trigger element including a heat sensitive element; and an anti-skipping shield extending circumferentially around the heat sensitive element. The anti-skipping shield has an upper end and a lower end. The anti-skipping shield is open at the upper end and at the lower end to permit airflow to the heat sensitive element around the upper end and the lower end of the anti-skipping shield.

15 Claims, 3 Drawing Sheets

OTHER PUBLICATIONS

John L. de Ris et al., "The Skip-Resistant Sprinkler Concept-Theoretical Evaluation", Journal of Fire Protection Engineering, pp. 1-14, Nov. 2009.

Benjamin Ditch et al., "The Skip Resistant Sprinkler Concept-An Experimental Evaluation", Journal of Fire Protection Engineering, pp. 1-15, Nov. 2009.

John L. de Ris et al., "The Skip-Resistant Sprinkler Concept—Theoretical Evaluation", Journal of Fire Protection Engineering, vol. 19, No. 4, pp. 275-289, Nov. 2009.

Benjamin Ditch et al., "The Skip Resistant Sprinkler Concept—An Experimental Evaluation", Journal of Fire Protection Engineering, vol. 19, No. 4, pp. 291-308, Nov. 2009.

* cited by examiner

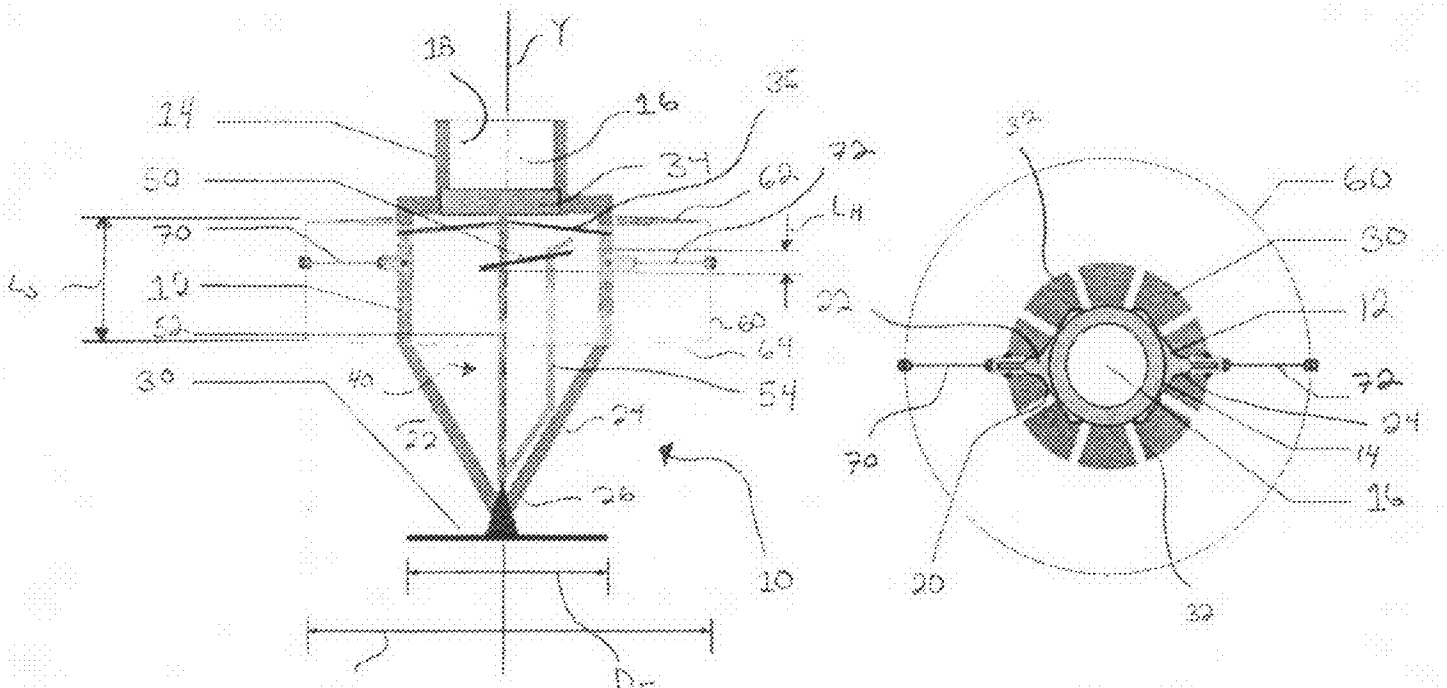
FIG. 1
FIG. 2
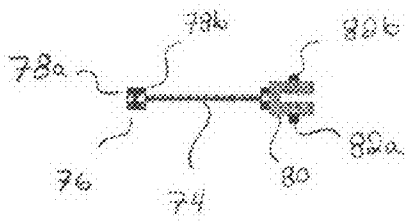
FIG. 3

ANTI-SKIPPING SPRINKLER

TECHNICAL FIELD

This invention relates generally to sprinklers for use in fire protection, and more specifically, to sprinklers resistant to the skipping phenomenon.

BACKGROUND

Automatic sprinklers for use in fire protection typically include a trigger comprising a heat sensitive element, such as a fusible link or glass bulb. The trigger causes the sprinkler to automatically open and dispense water when the heat sensitive element reaches a predetermined temperature, for example, in response to a nearby fire. In the case of multiple sprinklers located near one another, the water dispensed from an open sprinkler may land on the heat sensitive element of a nearby closed sprinkler, thereby cooling the heat sensitive element of the closed sprinkler, and undesirably delaying or preventing it from opening. This phenomenon is typically known in the art as "skipping." To reduce the possibility of this happening, sprinklers are sometimes installed at a certain distance from one another. However, when a fire is located under an open sprinkler, the rising gasses, smoke, etc., caused by that fire can carry water droplets from the sprinkler upward and sideways, and can cause those droplets to land on the heat sensitive element of nearby, closed sprinklers. These water droplets can cool the heat sensitive element of the nearby, closed sprinklers, causing "skipping" of the nearby closed sprinklers.

SUMMARY

The present invention relates generally to an anti-skipping sprinkler. An anti-skipping sprinkler can comprise a fire protection sprinkler with a passive mechanism that blocks water droplets dispensed from nearby sprinklers from impacting the anti-skipping sprinkler's heat sensitive element. Such impacting of water drops has been shown to delay or prevent the normal operation of a sprinkler. An exemplary anti-skipping sprinkler can have a shield that extends circumferentially around the sprinkler's heat sensitive element and protects the heat sensitive element from impingement by water droplets, such as those dispensed by nearby open sprinklers, and/or those carried by plumes of gas or smoke. The shield allows airflow to reach the heat sensitive element from above and below the shield, so as not to interfere with the heat sensitive element's ability to respond to temperature changes. In addition, the shield does not unduly interfere with the sprinkler's spray pattern when in an open state.

According to an exemplary embodiment, an anti-skipping sprinkler includes a frame defining a central longitudinal axis, the frame including a base portion defining an orifice, and first and second arms extending away from the base portion and joining at a lower end of the frame; a deflector located at the lower end of the frame; an orifice plug held over the orifice by a trigger element comprising a heat sensitive element; and an anti-skipping shield extending circumferentially around the heat sensitive element. The anti-skipping shield has an upper end and a lower end. The anti-skipping shield is open at the upper end and at the lower end to permit airflow to the heat sensitive element around the upper end and the lower end of the anti-skipping shield.

Further objectives and advantages, as well as the structure and function of illustrative embodiments, will become apparent from a consideration of the description and drawings.

BRIEF DESCRIPTION OF THE DRAWINGS

The foregoing and other features and advantages of the invention will be apparent from the following, more particular description, as illustrated in the accompanying drawings wherein like reference numbers generally indicate identical, functionally similar, and/or structurally similar elements.

FIG. 1 is a schematic, side view of a first illustrative embodiment of a sprinkler having an anti-skipping shield according to the present invention;

FIG. 2 is a top view of the sprinkler and anti-skipping shield of FIG. 1;

FIG. 3 is top view of a mounting arm for mounting an anti-skipping shield to a sprinkler according to an illustrative embodiment of the present invention;

DETAILED DESCRIPTION

Figure 4:
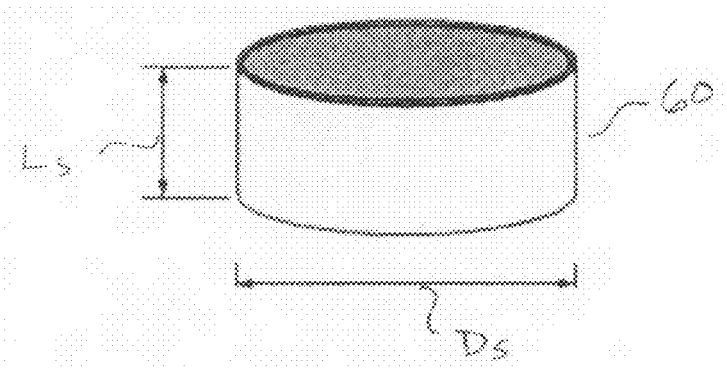
FIG. 4 is a perspective view of the anti-skipping shield of FIG. 1.

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

Referring to FIGS. 1 and 2, shown is an exemplary embodiment of an anti-skipping sprinkler 10 for suppressing fires. Sprinkler 10 can be of the pendant, recessed pendant, upright, or other known configuration. Sprinkler 10 can include, for example, an open frame 12 including a base portion 14. The base portion 14 can define an orifice 16 that allows water, foam, and/or another fire retardant substance to pass through the base portion 14. The base portion 14 can include internal or external threads 18, or other fastening structures, to allow the sprinkler 10 to be mounted to a fire-fighting system, for example, a network of pipes. As shown in FIG. 2, the base can include wrench flats 20, or similar structures, to facilitate mounting of the sprinkler 10 to the fire-fighting system.

Still referring to FIGS. 1 and 2, the frame 12 can include at least first and second arms 22, 24 extending away from base portion 14. Arms 22, 24 can join one another proximate a lower end 26 of the frame 12, for example, in the shape of an open arc. All or some of the frame 12 (e.g., base 14, first and second arms 22, 24, wrench flats 20, and/or any additional components) can be of unitary construction, or alternatively, can be formed of individual parts that are joined together. The frame 12 can be made of copper, brass, stainless steel, bronze, and/or other corrosion-resistant materials known in the art. Frame 12 can generally define a longitudinal axis Y extending, for example, centrally through the base portion 14 and through the lower end 26, as illustrated in FIG. 1.

Sprinkler 10 can also include a deflector 30 attached to its lower end 26, for example, by a compression screw (not shown) or other fastener that extends into the frame 12 at the junction of the arms 22, 24. As shown in the top view of FIG.

Figure 7:
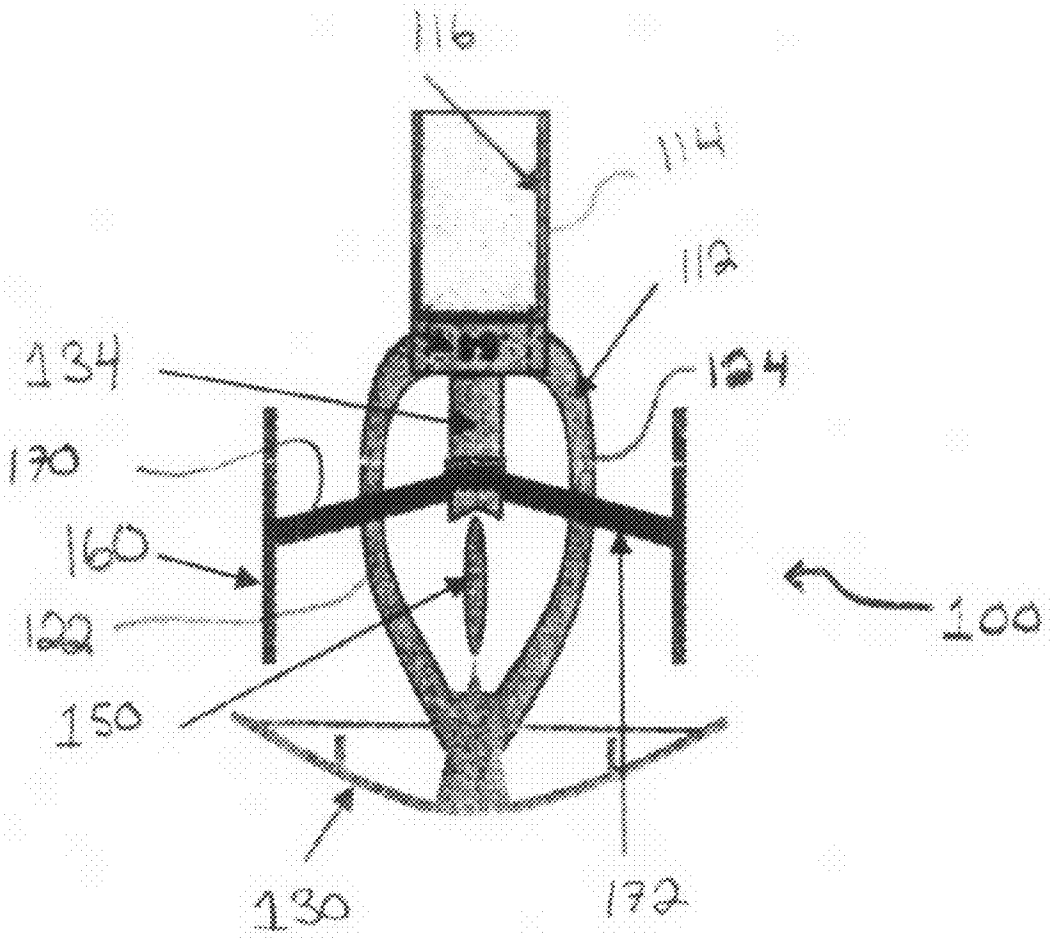
FIG. 7 is a side view of a second illustrative embodiment of a sprinkler having an anti-skipping shield according to the present invention.

2, deflector 30 can be generally circular in shape and can have one or more slots 32 extending inward from its periphery, although other shapes and configurations of deflectors known in the art are also possible, such as the deflector 130 shown in FIG. 7. Deflector 30 can generally define a diameter $D_F$, as illustrated in FIG. 1.

As best shown in FIG. 1, sprinkler 10 can include an orifice plug 34 releasably held over the orifice 16 by a trigger element (discussed below). Orifice plug 34 can have a size and shape that substantially corresponds to a portion of the orifice 16, such that the orifice plug 34 seals the orifice 16 and prevents fluid flow through the orifice 16 when the orifice plug 34 is in place. Accordingly, the sprinkler 10 can be mounted to an open water source of a sprinkler system, and the orifice plug 16 can prevent fluid flow through the sprinkler 10 until the trigger element (discussed below) has been triggered, for example, in response to a fire.

Still referring to FIG. 1, sprinkler 10 can include a trigger element 40 that triggers at a predetermined temperature, and allows the orifice plug 34 to eject from the orifice 16 under the pressure of the water, foam, and/or other fire retardant substance behind it. Trigger element 40 can comprise multiple parts that operate together, as shown in the center-strut embodiment of FIG. 1, or alternatively, can comprise a single component, such as the glass-bulb embodiment shown in FIG. 7. According to either embodiment, the trigger element 40 comprises a heat sensitive element 50 that reacts (e.g., breaks, melts, expands, shrinks) at a predetermined temperature to cause the sprinkler 10 to open and dispense water, foam, and/or another fire retardant substance.

Referring to FIG. 1, the exemplary trigger element shown is of the multi-part variety, and comprises a link arm 52 positioned between the orifice plug 16 and the lower end 26 of the frame 12, a bent linkage 54 positioned to act on the link arm 52, and a fusible heat sensitive element 50 that holds the bent linkage 54 in the position shown in FIG. 1. When the heat sensitive element 50 reaches a predetermined temperature (e.g., in response to a fire), it melts, evaporates, or otherwise disappears, and releases the bent linkage 54. This allows the bent linkage 54 to act on the link arm 52 to pull it out of the position shown in FIG. 1, thereby providing a clearance for the orifice plug 34 to move out of the orifice 16 under the pressure of fluid behind it, thereby opening the sprinkler 10. A kick spring 35, kick sprinkler, or similar device can also act on the link arm 52 and/or orifice plug 34 to ensure that they completely clear the sprinkler 10 upon release of the heat sensitive element 50. For example, as shown in FIG. 1, kick spring 35 can comprise a curved spring steel wire that acts against the arms 22, 24 and link arm 52 to put tension on link arm 52, however, other configurations are possible. One of ordinary skill in the art will appreciate that sprinkler 10 is not limited to the type of trigger element shown in FIG. 1, and that many different types of multi-part and single-part trigger elements known in the art can alternatively be used.

In order to protect the heat sensitive element 50 from being affected (e.g., cooled) by water droplets, mist, etc., being ejected by nearby sprinklers, or else traveling on rising plumes of hot gasses and smoke, the sprinkler 10 can include an anti-skipping shield 60. As shown in FIGS. 1 and 2, the shield 60 can extend circumferentially around the sprinkler 10, or part of the sprinkler 10. For example, in the exemplary embodiment of FIGS. 1 and 2, the shield 60 extends circumferentially around the arms 22, 24, however, the shield 60 can alternatively be located within the arms 22, 24 and extend only around the trigger element or the heat sensitive element 50. According to the exemplary embodiment shown in FIGS. 1 and 2, the shield 60 extends continuously around the sprinkler 10, as best shown in FIG. 2.

According to an exemplary embodiment shown in FIG. 1, the heat sensitive element 50 defines a first length $L_H$ along the axis Y, and the shield 60 defines a second length $L_S$ along the axis Y. The second length $L_S$ can be equal to or greater than the first length $L_H$, thereby improving the protection of the heat sensitive element 50, however, other configurations are possible. According to an exemplary embodiment, the shield 60 is shaped and dimensioned so that it does not interfere with ejection of the orifice plug 34 from the orifice 16; likewise, it does not unduly interfere with the spray pattern of the sprinkler 10 when in an open state.

Referring specifically to FIG. 1, the shield 60 can have an upper end 62 and a lower end 64. The shield 60 can be open at the upper end 62 and/or at the lower end 64. According to this configuration, airflow can reach the heat sensitive element 50 from above the upper end 62 and/or from below the lower end 64 of the shield 60, while water droplets, mist, etc., are prevented from directly impinging on the heat sensitive element 50 (e.g., from the side). As a result of this configuration, the shield can protect the heat sensitive element 50 from water droplets, mist, etc., while at the same time allow the heat sensitive element 50 to remain sensitive to changes in temperature of the surrounding air. The shield 60 can generally define a diameter $D_S$, which may be larger than the diameter $D_F$ of the deflector 30, however, other configurations are possible.

Figure 5:
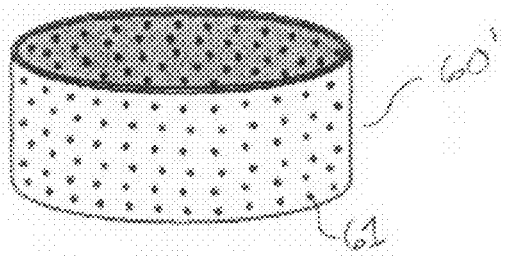
FIG. 5 is a perspective view of a second illustrative embodiment of an anti-skipping shield according to the present invention.
Figure 6:
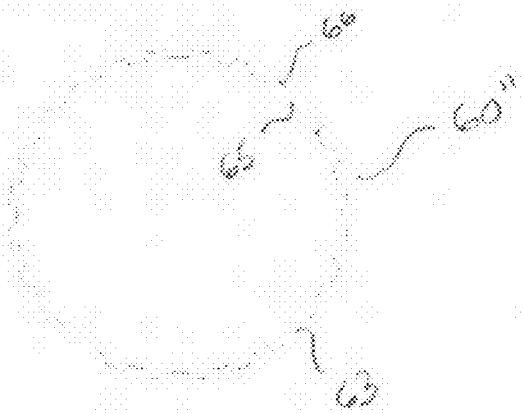
FIG. 6 is a top view of a third illustrative embodiment of an anti-skipping shield according to the present invention.

Referring to FIGS. 4 and 5, various exemplary embodiments of the anti-skipping shield are shown. For example, the shield 60 shown in FIG. 4 is the same as that shown in FIGS. 1 and 2, and is of substantially solid construction. The shield 60 can comprise a substantially continuous piece of sheet metal. The shield 60' shown in FIG. 5 includes multiple perforations 61. According to an exemplary embodiment, the perforations 61 are small enough to prevent water droplets or mist from passing therethrough, yet are large enough to allow airflow to pass therethrough. The shield 60" of FIG. 6 can comprise multiple louvers 63. According to an exemplary embodiment, the louvers 63 are small enough to prevent water droplets or mist from passing therethrough, yet are large enough to allow airflow to pass therethrough. As shown in FIG. 6, the louvers 63 can comprise an inner slotted shield 65 and an outer slotted shield 66 fitted together with their respective slots slightly out of phase, thereby forming the louvers 63, although other configurations are possible. According to an exemplary embodiment, the anti-skipping shield is formed from stainless steel, however, other materials are possible. The size and shape of the perforations 61 and/or the louvers 63 can be based on the expected drop diameter of water droplets. For example, in the case where perforations 61 are round, the perforations can have a diameter that is slightly smaller than the expected diameter of the impinging water droplets.

According to the exemplary embodiment of FIGS. 1 and 2, the shield 60 can be attached to the sprinkler 10 via the frame 12. For example, the shield 60 can be attached to the first and second arms 22, 24. The shield 60 can be permanently attached to the sprinkler 10, or alternatively, can be removably and replaceably attached to sprinkler 10. According to another exemplary embodiment, the shield 60 can be adapted to be retrofitted onto conventional sprinklers. According to another exemplary embodiment, the shield 60 can be integrated into the frame 12 itself, for example, they can comprise an integrated unit.

Referring to FIGS. 1-3, the shield 60 can be attached to the frame 12 via first and second mounting arms 70, 72. Referring to FIG. 3, each of the mounting arms 70, 72 can comprise a threaded rod 74 having a first end 76 that extends through an aperture in the shield 60 and is connected thereto via a pair of hex nuts 78*a*, 78*b*. The threaded rod 74 can also have a second end that is connected to the sprinkler frame 12, for example, by a slotted attachment housing 80. Each attachment housing 80 can sandwich a portion of the frame 12, and can be secured thereto by a pair of opposed set screws 82*a*, 82*b*, as shown. One of ordinary skill in the art will understand, however, that other configurations of the mounting arms are possible.

Referring to FIG. 7, an alternative embodiment of a sprinkler 100 is shown, where the anti-skipping shield 160 is attached to the orifice plug 134. Sprinkler 100 can include a frame 112 that is generally similar to that shown in FIGS. 1 and 2. For example, frame 112 can include a base 114 defining an orifice 116, and first and second arms 122, 124. Sprinkler 100 can further include a deflector 130, an orifice plug 134 blocking the orifice 116, and a trigger element comprising a heat sensitive element 150 in the form of a glass bulb. When the glass bulb reaches a predetermined temperature, it breaks, thereby allowing the orifice plug 134 to exit the orifice 116 under the pressure of the fluid behind it, thereby activating the sprinkler 100. As mentioned previously, the shield 160 can be attached to a portion of the orifice plug 134, for example, by mounting arms 170, 172. The shield 160 can be permanently attached to the orifice plug 134, or alternatively, can be removably and replaceably attached thereto. Additionally or alternatively, the shield 160 can be adapted to be retrofitted onto the orifice plug of conventional sprinklers.

The anti-skipping shield 60, 160 of the present invention can be sized and dimensioned to prevent water droplets from directly impinging on the heat sensitive element 50, 150, for example, from neighboring sprinklers. Additionally, the shield 60, 160 can be configured and dimensioned so as not to unduly impede heat transfer to the heat sensitive element 50, 150, for example, by being open at the top and bottom. Heat transfer to the heat sensitive element 50, 150 can be further facilitated by providing perforations, louvers, or similar features on the shield 60, 160.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An anti-skipping sprinkler, comprising:

a frame defining a central longitudinal axis, the frame including a base portion defining an orifice, and first and second arms extending away from the base portion and joining at a lower end of the frame;

a deflector located at the lower end of the frame;

an orifice plug held over the orifice by a trigger element, the trigger element comprising a heat sensitive element;

an anti-skipping shield extending circumferentially around the heat sensitive element, the anti-skipping shield having an upper end and a lower end, wherein the anti-skipping shield is open at the upper end to permit airflow to the heat sensitive element around the upper end of the anti-skipping shield, and the anti-skipping shield is permanently open at the lower end to permit fluid exiting the orifice to spray through the lower end of the anti-skipping shield;

a first mounting arm extending from the first arm to the anti-skipping shield, wherein the first mounting arm is coupled to the anti-skipping shield at a position between the upper end and the lower end of the anti-skipping shield; and a second mounting arm extending from the second arm to the anti-skipping shield, wherein the second mounting arm is coupled to the anti-skipping shield at a position between the upper end and the lower end of the anti-skipping shield.

2. The anti-skipping sprinkler of claim 1, wherein the anti-skipping shield extends substantially continuously about the heat sensitive element in a circumferential direction with respect to the central longitudinal axis.

3. The anti-skipping sprinkler of claim 2, wherein the anti-skipping shield is substantially solid.

4. The anti-skipping sprinkler of claim 2, further comprising louvers or perforations on the anti-skipping shield, the louvers or perforations sized and dimensioned to permit airflow through the louvers or perforations.

5. The anti-skipping sprinkler of claim 1, wherein the anti-skipping shield is permanently attached to the frame.

6. The anti-skipping sprinkler of claim 1, wherein the anti-skipping shield is integrated with the frame.

7. The anti-skipping sprinkler of claim 1, wherein the anti-skipping shield surrounds at least a portion of the first and second arms.

8. The anti-skipping sprinkler of claim 1, wherein the heat sensitive element defines a first length along the central longitudinal axis, the anti-skipping shield defines a second length along the central longitudinal axis, and the second length is equal to or greater than the first length.

9. The anti-skipping sprinkler of claim 8, wherein the second length is long enough to prevent the heat sensitive element from being impinged by water droplets being expelled by nearby sprinklers.

10. The anti-skipping sprinkler of claim 1, wherein the heat sensitive element comprises a fusible sensitive link, a glass bulb, or a quartzoid element.

11. The anti-skipping sprinkler of claim 1, wherein the anti-skipping shield is made of sheet metal.

12. The anti-skipping sprinkler of claim 11, wherein the sheet metal comprises stainless steel, copper, or bronze.

13. The anti-skipping sprinkler of claim 11, wherein the sheet metal comprises a corrosion-resistant material.

14. The anti-skipping sprinkler of claim 1, wherein fluid exits the orifice in a spray pattern when the orifice is in an open state, and the anti-skipping shield does not substantially interfere with the spray pattern.

15. The anti-skipping sprinkler of claim 1, wherein the anti-skipping shield is substantially cylindrical, and is substantially unenclosed at the upper end and the lower end.

* * * * *